United States Patent [19]

Kirkland

[11] 4,162,020

[45] Jul. 24, 1979

[54] ANTI-SPILL DEVICE

[75] Inventor: Edward O. Kirkland, Riverton, Wyo.

[73] Assignee: Donald K. Smith, Sterling, Colo.

[21] Appl. No.: 803,277

[22] Filed: Jun. 3, 1977

[51] Int. Cl.[2] ..... B65D 25/20; B65D 25/56

[52] U.S. Cl. ..... 220/1 B; 220/1 C; 220/203; 220/DIG. 5

[58] Field of Search ..... 222/108–111; 137/572, 563, 312, 590.5, 314; 141/339, 115, 392, 86; 52/13, 15; 215/100.5; 220/DIG. 5, 85 R, 86, 83 UR, 85 US, 203, 85 SP, 208, 1 B, 1 C, 88 R, 228, DIG. 6, 85 S; 184/106

[56] References Cited

U.S. PATENT DOCUMENTS

| | | | |
|---|---|---|---|
| 244,276 | 7/1881 | Maule | 222/111 |
| 272,415 | 2/1883 | Crapon et al. | 141/339 |
| 1,352,792 | 9/1920 | Day | 220/86 R |
| 1,554,773 | 9/1925 | Wiggins | 220/228 |
| 1,680,060 | 8/1928 | Nelson | 220/228 |
| 2,318,462 | 5/1943 | Burdick | 220/86 R |
| 2,406,521 | 8/1946 | Wiggins | 220/85 R |
| 2,457,155 | 12/1948 | Jackson | 220/85 R |
| 2,554,178 | 5/1951 | Flickinger | 220/88 R |
| 2,583,725 | 1/1952 | Brown et al. | 137/312 |
| 2,712,395 | 7/1955 | Wiggins | 220/DIG. 6 |
| 2,805,631 | 9/1957 | Wiggins | 52/13 |
| 3,410,438 | 11/1968 | Bartz | 220/1 C |
| 4,013,105 | 3/1977 | Uuskallio | 184/106 |

*Primary Examiner*—William Price
*Assistant Examiner*—Allan N. Shoap
*Attorney, Agent, or Firm*—Charles E. Brown

[57] ABSTRACT

This relates to an anti-spill device to be utilized in conjunction with a hatch located on the top or roof section of a liquid storage vessel, particularly a petroleum liquid storage vessel. This device is in the form of a pan which is positioned between the hatch and the vessel roof with the pan being configurated for adequately holding on a temporary basis spilled liquid, and the pan having drain means for draining the spill to a suitable storage point.

6 Claims, 5 Drawing Figures

FIG.1
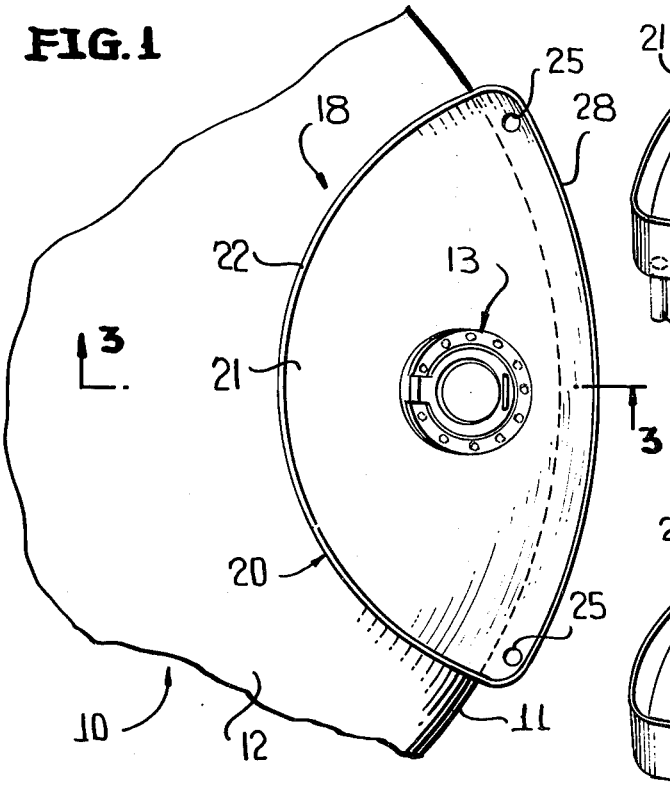
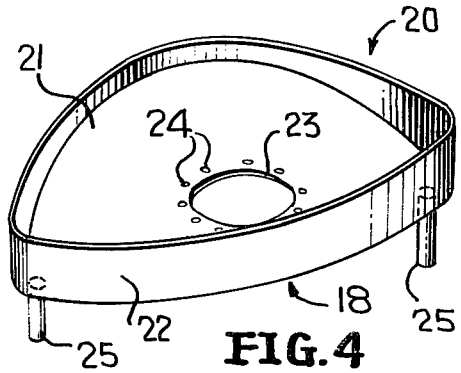
FIG.4
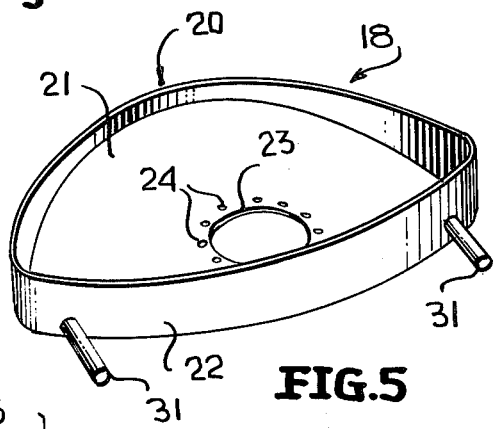
FIG.5
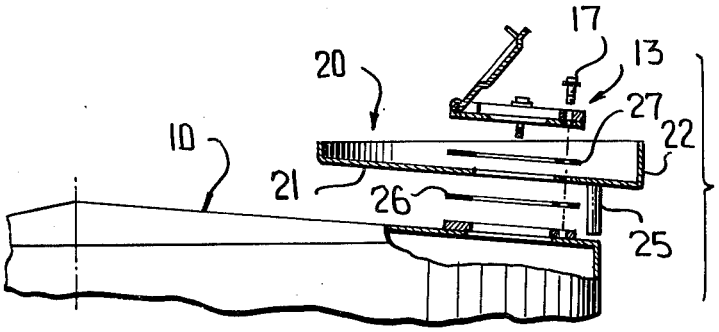
FIG.2
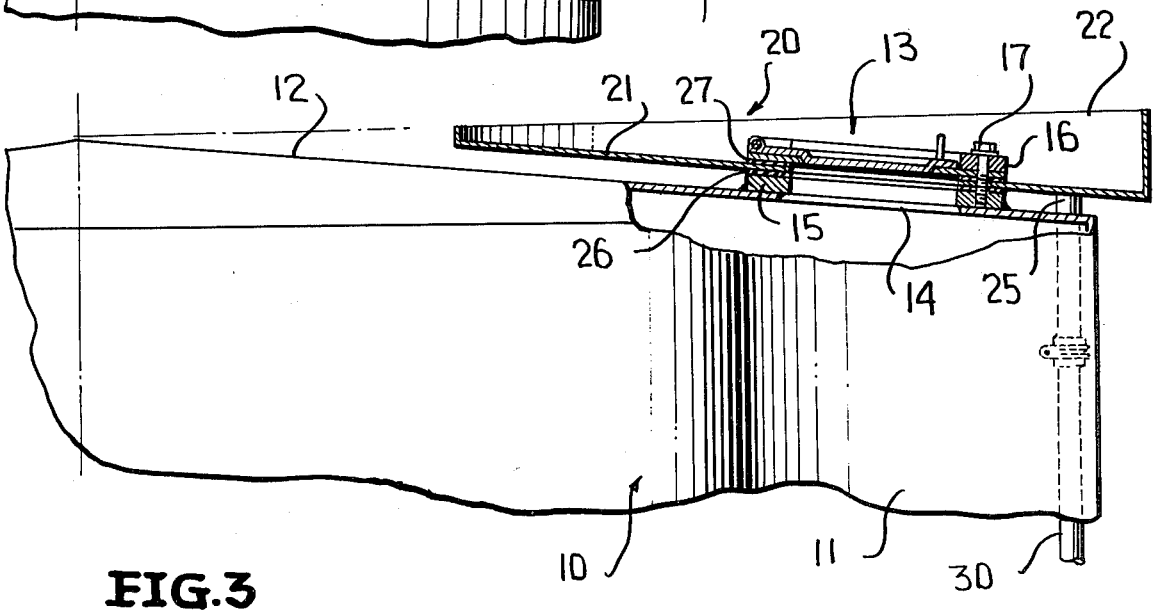
FIG.3

ANTI-SPILL DEVICE

This invention relates in general to new and useful improvements in liquid storage or handling vessels or tanks, and most particularly to an anti-spill device for use in conjunction with hatches formed on the roofs of such vessels or tanks.

With respect to the oil industry in general, most oil field vessels are manufactured to American Petroleum Institute standards in regard to size and configuration. Most of these vessels are tanks are also equipped with at leat one opening, usually called a thief or gauge hatch which is located on the top or roof section of the vessel. This opening provides access to the vessel for periodic gauging and sampling of the contained liquid.

In the event a tank is filled beyond its capacity, the thief hatch provides a means for allowing the product to escape the tank before the designed burst pressure of the tank is reached. Because of the design of the thief hatch, this occasionally results in an uncontrolled spillage of liquid over the side of the tank.

It is an object of this invention to provide an anti-spill device that can be installed on or around the thief hatch to allow for the containment of the escaping liquid and to provide for the transfer of such liquid to a safe and environmentally suitable location.

A properly designed anti-spill device in accordance with this invention will intercept and transfer 100% of the spillage.

In accordance with this invention the anti-spill device is in the form of a generally oval shaped pan which includes a bottom wall having an access opening which corresponds to the opening through the hatch, and the bottom wall is mounted directly on the roof below the hatch. In most instances the hatch is secured to the roof by means of a flange having bolt holes therein and bolts are utilized for the securement of the hatch in place. The bottom wall of the pan will have a bolt pattern to match that of the hatch flange so that the same bolts may be utilized to install the pan. Suitable gasket means, of course, will prevent leakage between the mounting flange, the pan and the hatch flange.

It is proposed that the pan extend beyond the edge of the roof so that the drain means may be in the form of simple vertical pipes which extend downwardly from the bottom wall of the pan outside of the tank with the pipes having connected thereto suitable carry-away piping.

When the roof is a sloping roof, the bottom wall of the pan will be parallel to the roof and thus the peripheral wall of the pan will be of varying height so that the upper edge of the peripheral wall will lie substantially in a horizontal plane.

It is also proposed that when the pan is mass produced for a particular size of tank, the outer edge of the pan and the associated portion of the peripheral wall be disposed concentric with the tank wall.

With the above and other objects in view that will hereinafter appear, the nature of the invention will be more clearly understood by reference to the following detailed description, the appended claims and the several views illustrated in the accompanying drawing.

In the drawings:

FIG. 1 is a fragmentary plan view of a tank having mounted thereon beneath the hatch thereof an anti-spill device in accordance with the invention.

FIG. 2 is a fragmentary exploded elevational view with parts broken away and shown in section of the anti-spill device and the hatch with which it is associated.

FIG. 3 is an enlarged fragmentary sectional view taken along the line 3—3 of FIG. 1, and shows more specifically the mounting of the anti-spill device.

FIG. 4 is a top perspective view of the anti-spill device.

FIG. 5 is a top perspective view of a slightly modified form of anti-spill device.

Referring now to the drawing in detail, it will be seen that there is illustrated a conventional storage vessel or tank, generally identified by the numeral 10. The tank 10 will normally have an upstanding side 11 of a circular outline and is closed by means of a roof 12 which slopes downwardly and outwardly, as is best shown in FIG. 3. Adjacent the side of the tank, the roof 12 will be provided with a hatch generally identified by the numeral 13. Various names may be applied to such a hatch, although it is normally identified as being a thief hatch or a gauging hatch, and in certain instances the hatch is constructed so that it will leak vapors and liquid from within the tank at a predetermined pressure.

The roof 12 has an access opening 14 therethrough which is surrounded by a mounting flange 15. The mounting flange 15 is aligned with a mounting flange 16 of the hatch and bolts 17 removably secure the hatch to the roof.

In accordance with this invention it is proposed to provide the tank with an anti-spill device, generally identified by the numeral 18. The anti-spill device 18 is fixedly mounted relative to the roof 12 for receiving and containing liquid which may spill from the hatch 13.

As is best shown in FIGS. 3 and 4 the anti-spill device is generally in the form of a pan 20 which includes a bottom wall 21 and an upstanding peripheral wall 22. The pan 20 has a generally oval shape outline, as is best shown in FIG. 1, and when the pan is to be mounted on a sloping roof the peripheral wall 20 has an upper edge which lies generally in a horizontal plane, as is best shown in FIG. 3.

The bottom wall 21 has an access opening 23 which is aligned with the mounting flange 15 so as to in no way interfere with the function of the hatch 13. Surrounding the access opening 23 are a plurality of holes 24 which are arranged in the same pattern as the bolts 17 for receiving the bolts.

The pan 20 is also provided with a pair of drain tubes or pipes 25 which are secured to the underside of that portion of the bottom wall 21 which is disposed outermost for receiving the contained spillage and directing such spillage to a suitable collection or storage area.

As is best shown in FIG. 2, in order to mount the pan 20 the hatch 13 is removed and the bottom wall 21 of the pan 20 is seated on the usual gasket 26 which is disposed between the hatch flange 16 and the mounting flange 15. A second gasket 27, preferably identical to the gasket 26, overlies the pan bottom wall, after which the hatch 13 is repositioned and secured in place by the bolts 17. Thus no special fittings are required to mount the anti-spill device 18. On the other hand, the mounting is such that the pan 20 is sealed relative to the roof 12 and the hatch mounting flange 16.

Returning once again to FIG. 1, it will be seen that the pan 20 has an outer edge portion 28 which is arcuate and is disposed concentric to the tank wall 11, the pan extending outwardly beyond the roof 12 with the drain pipes 26 extending down alongside the tank. The edge of the pan 20 remote from the edge portion 28 is also arcuate, but is preferably of a sharper curvature. Thus, the over-all outline of the pan 20 is generally oval.

As will be apparent from FIG. 3, the hatch is disposed totally within the pan 20 and any spillage through the hatch will be contained within the pan. Because the upper edge of the peripheral wall 22 lies in a substantially horizontal plane, the entire pan 20 has to be filled before there is an overflow or actual spillage of the liquid from the tank. By properly designing the drain pipes 25 and any carry-away piping 30 (FIG. 3) associated therewith, all spillage will be contained and delivered to a proper collection area.

While it is preferred that the pan 20 extend beyond the roof of the tank, in instances where it is not feasible or desirable so to project the tank, the outer portion of the peripheral wall 20 may be provided with outwardly and downwardly directed drain pipes 31, as is shown in FIG. 5. However, the arrangement shown in FIG. 4 is preferred.

With respect to the invention, it is pointed out here that the liquid stored in vessels, particularly oil field vessels, are volatile hydrocarbon products or impure toxic waters. Uncontrolled spillage of these liquids presents several severe problems and hazards. Recent legislation imposes strict regulations and possible fines for spilling oil field products and byproducts into the environment, and clean-up costs can be very expensive. Additionally, spillage may present a severe fire as well as a personal safety hazard. In addition, if a hydrocarbon is spilled the spillage becomes waste unless it is properly contained. The anti-spill device set forth above will prevent uncontrolled spillage, and when properly utilized serves to collect the spilled liquid so as to prevent the loss thereof.

Although only a preferred embodiment of the invention has been specifically illustrated and described herein, minor variations may be made in the anti-spill device without departing from the spirit and scope of the invention as defined by the appended claims.

I claim:

1. A storage tank assembly comprising a storage tank having a roof and an upstanding wall, and a hatch with an openable cover carried by said roof adjacent an edge of said roof, said hatch and said roof having mating mounting flanges, and an anti-spill device associated with said hatch for collecting spillage through said hatch, said anti-spill device including a pan having a bottom wall interposed between said hatch mounting flange and said roof mounting flange, said bottom wall of said pan having an access opening therethrough aligned with said hatch and an upstanding peripheral wall, and drain means connected to said pan.

2. The storage tank assembly of claim 1 wherein said pan extends beyond said roof and said drain means are vertically disposed outwardly of said roof.

3. The storage tank of claim 2 wherein said tank is circular, has a center and is of a preselected radius, said pan bottom wall has an arcuate outer edge portion of a radius from substantially said tank center greater than said tank radius wherein said pan outer edge is generally concentric to said tank.

4. The storage tank assembly of claim 1 wherein said roof slopes, said bottom wall is generally parallel to said roof and said peripheral wall has a generally horizontally disposed planar upper edge.

5. The storage tank assembly of claim 1 wherein said hatch mounting flange is secured to said tank mounting flange by a plurality of spaced bolts, and said bolts pass through said pan bottom wall.

6. The storage tank of claim 1 wherein said hatch cover is freely accessible and openable within said pan.

* * * * *